US007763803B2

(12) United States Patent
MacRae, Sr.

(10) Patent No.: US 7,763,803 B2
(45) Date of Patent: Jul. 27, 2010

(54) HIGH FIDELITY SIGNAL TRANSMISSION CABLE

(76) Inventor: James D. MacRae, Sr., 18900 Rutledge Rd., Deephaven, MN (US) 55391

( * ) Notice: Subject to any disclaimer, the term of this patent is extended or adjusted under 35 U.S.C. 154(b) by 262 days.

(21) Appl. No.: 12/035,611

(22) Filed: Feb. 22, 2008

(65) Prior Publication Data

US 2008/0202791 A1 Aug. 28, 2008

Related U.S. Application Data

(60) Provisional application No. 60/891,430, filed on Feb. 23, 2007.

(51) Int. Cl.
*H01B 7/00* (2006.01)

(52) U.S. Cl. ..... 174/110 R; 174/113 R; 174/113 C; 174/36

(58) Field of Classification Search ..... 174/36, 174/110 R, 113 R, 113 C, 112, 115, 117 R, 174/117 F, 117 FF, 27, 28
See application file for complete search history.

(56) References Cited

U.S. PATENT DOCUMENTS

| | | | | | |
|---|---|---|---|---|---|
| 2,626,223 | A * | 1/1953 | Ford et al. | ..... | 525/421 |
| 3,048,078 | A * | 8/1962 | Kaplan et al. | ..... | 87/1 |
| 4,767,890 | A * | 8/1988 | Magnan | ..... | 174/28 |
| 5,110,999 | A * | 5/1992 | Barbera | ..... | 174/36 |
| 5,266,744 | A * | 11/1993 | Fitzmaurice | ..... | 174/103 |
| 5,376,758 | A * | 12/1994 | Kimber | ..... | 174/128.1 |
| 6,269,167 | B1 * | 7/2001 | Mango et al. | ..... | 381/410 |
| 6,388,188 | B1 * | 5/2002 | Harrison | ..... | 174/27 |
| 2005/0121222 | A1 * | 6/2005 | Lee | ..... | 174/113 R |

* cited by examiner

*Primary Examiner*—William H Mayo, III
(74) *Attorney, Agent, or Firm*—Nawrocki, Rooney & Sivertson, P.A.

(57) ABSTRACT

A high accuracy cable for transmitting audio and video signals having a sleeve of natural fiber material such as cotton surrounding each conductor and a spacer formed from a natural fiber that maintains substantially constant spacing between the conductors, wherein the conductors at least partly are formed from gold and/or silver.

17 Claims, 1 Drawing Sheet

HIGH FIDELITY SIGNAL TRANSMISSION CABLE

CLAIM OF PRIOR APPLICATION FILING DATE

This is a regular application filed under 35 U.S.C. §111(a) claiming priority under 35 U.S.C. §119(e)(1), of provisional application Ser. No. 60/891,430, filed Feb. 23, 2007, and incorporated herein by reference in its entirety.

BACKGROUND OF THE INVENTION

High quality audio and video systems comprise individual component elements. Components such as tuners, receivers, media players, etc. originate audio or video signals. These signals are conducted to at least one amplifier or other processing component by cables. In the case of audio, the signals often have relatively low power and often are analog, i.e. have the audio content encoded in the amplitudes and phasing of the waveform.

In most cases each cable comprises at least one internal signal conductor and an outside shield that forms a second conductor. The cables terminate with one of a variety of different plugs or jacks that mate with connectors forming a part of the component involved. Such cables have been available of course, ever since recordings have existed whose sound content has been reproduced using electronic amplification. (Hereafter, "plug" will refer to the connecting element on the cable. "Socket" will refer to the connecting element usually present on the audio component housing.)

A variety of designs exists for connector plugs and jacks. Perhaps the most common is the RCA system, which has on a surface of the plug or jack, a central pin or prong to fit into a central hole on a corresponding socket. An annular ring projects from the surface and surrounds the pin of the plug. Pushing the plug into a corresponding socket, electrically connects the ring to the outer surface of a projecting socket ring. Other terminal systems have other arrangements.

Flat 75 Ω cable has been used has been used for many decades for RF conduction such as from a TV antenna to a TV set. 75 Ω cable has a pair of conventional copper wires embedded in a flat plastic strip that insulates the individual wires and holds them in a prescribed spacing.

BRIEF DESCRIPTION OF THE INVENTION

A high accuracy signal transmission cable connects to first and second plugs each having at least positive and neutral terminals and compatible with sockets on entertainment equipment. The cable has at least positive and neutral individual elongate conductors for connection between corresponding positive terminals and corresponding neutral terminals respectively, on the first and second plugs. These conductors are preferably formed at least partly of one or both of gold and silver.

A tube of natural fiber material such as cotton surrounds each conductor. A spacer formed from a natural fiber interposed between and attached to the conductors to maintain a predetermined range of spacing between the conductors. The spacer may be either a strip of adhesive paper or a rope of natural fiber such as cotton.

DESCRIPTION OF THE PREFERRED EMBODIMENTS

The FIGS. show designs for audio cables that many listeners agree improve quality of the reproduced signal compared to standard cables. The design may also provide benefits for transmitting video signals.

Figure 1:
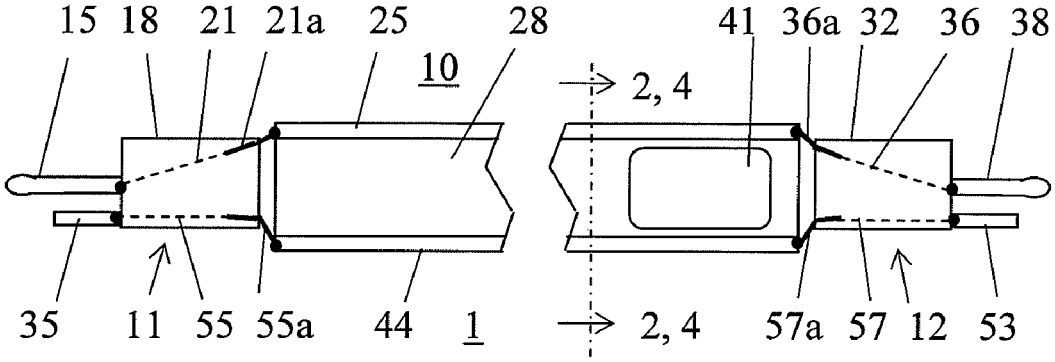
FIG. 1 is a side elevation view of a two-conductor audio cable in the form of a ribbon, with the width of the ribbon facing the viewer.
Figure 2:
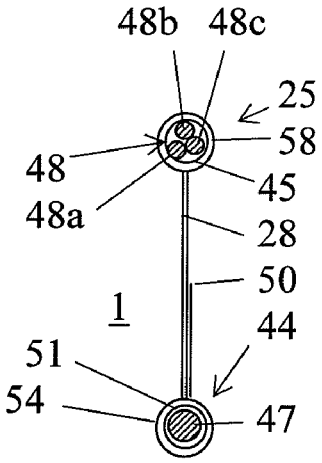
FIG. 2 shows the ribbon form of an audio cable shown in FIG. 1, in magnified cross section looking along the length thereof, as indicated by the section marked 2, 4-2, 4 in FIG. 1.

Experimentation shows that connecting component elements of audio systems using cables having the novel structures of cable 1 as shown in FIGS. 1-2 seems to produce perceptibly improved sound quality compared to those audio systems using standard cables. Objectively confirming this improved sound quality has not yet occurred, say by analyzing waveforms of the audio signals. Nevertheless, the consensus of audiophiles who listen to identical musical content played by audio systems using first standard cables and then cables having the construction of cable 1, is that sound quality is perceptibly better with these improved cables.

Figure 3:
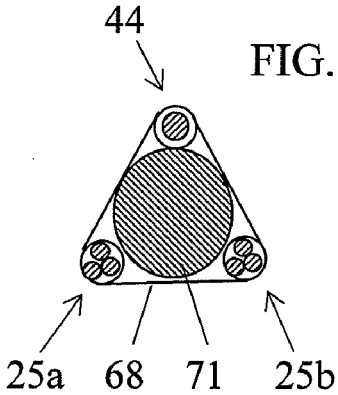
FIG. 3 is a longitudinal cross section of a variant of an audio cable showing three conductors and a rope-type spacer for a three-conductor audio cable.

Video systems may also benefit when using cables using the structure of FIGS. 1-3, although since at least digital video has very precisely controlled timing, coloration and phasing, the effect of cables having the structure of cable 1 may not be as pronounced, or may not even exist.

It is possible that cables having the design of cable 1 subtly reduce or otherwise affect phase shifts among the harmonics in intermediate stages of the audio signals when using standard cables to carry these intermediate audio signals to the individual components forming the audio systems. Under this hypothesis, these altered phase shifts are responsible for the perceived poorer performance of systems using standard cables. Highly sensitive audio spectrum analyzers may be able to identify the actual basis for the perceived improvement in sound quality, although no one has yet done this, to the inventor's knowledge. It is also possible that this novel audio cable design affects or produces the improved sound quality because of some other, unknown factor.

Cable 1 in FIGS. 1 and 2 has a number of features whose effect seems to substantially improve sound quality. Two or more of these features may synergistically cooperate, in that the combination of the features provides sound quality that audiophiles perceive as a substantial improvement over cables having only one or another of the features.

The plugs 1 1 and 12 at the ends of audio cable 1 are compatible with the standard two-conductor RCA sockets commonly found on audio system components. With slight modifications, the design of cable 1 may be adapted to incorporate XLR audio plugs. A common length for cable 10 is 1.5 m. (4.9 ft.).

Pins or prongs 15 and 38 on plugs 11 and 12 each fit into the central contact hole that serves as the positive terminal of an RCA socket. Projecting pins 35 and 53 each make interfering contact with the annular ring serving as the neutral terminal of an RCA socket.

The first of the features that seem to provide improved audio performance is a structure for cable 1 comprising a ribbon (FIGS. 1, 2, and 4) or rope (FIGS. 3 and 5) type spacer that maintain separation of positive and neutral conductors 47 and 48. Conductors 47 and 48 are mounted on opposite sides of spacer 10 as shown in the FIG. 2 cross section view. Loose weave insulating tubes or sleeves 51 and 45 formed of a natural fiber such as cotton, silk, or linen enclose respectively conductors 47 and 48, to form a pair of wires 44 and 25. The term "wire" hereafter refers to a conductor 47 or 48 and its surrounding sleeve 51 or 45.

Loose weave cotton sleeves 51 and 45 enclose conductors 47 and 48, and appear to be another important feature of cable 1 that provides superior sound quality. "Loose weave" means in this description as having at least approximately 50% volumetric voids, i.e., air pockets, within the weave. This can be measured in a number of ways, for example by measuring the volume with no compression, compressing the material to say a pressure of 20 psi., and then calculating the change in volume.

The preferred design at this time is for conductor 48 to comprise three substantially parallel strands 48*a*, 48*b*, and 48*c*. The use of three individual wires to comprise conductor 48 also yields improved sound quality, although again, the improvement seems to be less dramatic than for other features to be mentioned. As shown in FIG. 2, conductor 47 is a single strand, but may also comprise two or more strands, with loose weave sleeves around either each or all. For certain types of metals comprising conductor 47, this is preferable.

The metal(s) chosen for conductors 47 and 48 seems to affect to some extent, the sound quality produced by a system using a cable 1 for audio signal conduction. The term "precious metal" hereafter includes gold and silver. The term "high purity" refers to 24K gold and 99% or higher purity silver.

The use of 24K gold for the strands forming conductors 47 and 48 appears to produce a perceptible improvement in sound quality compared to other metals other than 24K gold. As mentioned above, other precious metals besides gold, particularly silver, comprising conductors 47 and 48 also seem to yield improved sound quality over plain copper.

In the design that seemingly provides highest sound quality, each strand 48*a*-48*c* comprises 30 ga. 24K gold, ideally 99.99% pure. Conductor 47 preferably comprises a single 26 ga. strand of 99.99% pure 24K gold with its own loose weave sleeve, two 28 ga. gold-plated silver strands with their own loose weave sleeves, and one 24 ga. and one 26 ga. gold-plated silver sharing a common loose weave sleeve.

Figure 4:
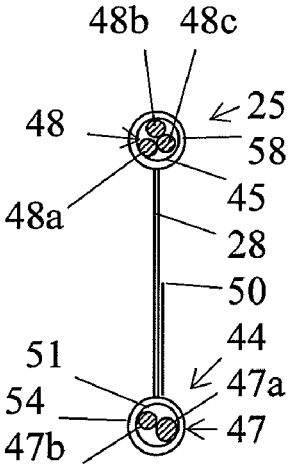
FIG. 4 a variation of the ribbon form of an audio cable shown in FIG. 1, in magnified cross section looking along the length thereof, as indicated by the section marked 2, 4-2, 4 in FIG. 1.

In another slightly less ideal embodiment, each strand 48*a*-48*c* comprises 28 ga. solid silver, preferably 99.95% pure, with a 2-3 micron 24K gold plating. Conductor 47 in this gold on silver embodiment may comprise two strands. FIG. 4 shows conductor 47 comprising a first strand 47*a* that may be 24 ga., and a second strand 47*b* that may be 26 ga., each made of nearly pure silver (99% pure or preferably 99.95% pure), one 24 ga. and one 26 ga. Each of the strands 47*a* and 47*b* comprise preferably has 24K gold plating with a thickness of 1-3 microns. For reasons that are not clear, forming a negative or neutral conductor 47 of multiple stands of gold-plated silver seems to provide enhanced fidelity, which does not seem to be the case when conductors 47 and 48 are solid gold.

In order of lowered sound quality, the strands forming conductors 47 and 48 may comprise solid sterling silver, gold-plated copper, silver-plated copper, and unplated solid copper.

While other types of materials forming sleeves 51 and 45 may provide a measure of improved sound quality, cotton appears to be the best. Sleeves 51 and 45 may fit either relatively loosely as shown in FIG. 2, or snugly, on conductors 47 and 48.

The loose weave design for sleeves 51 and 45 seems to be relatively important, perhaps because the loose weave allows for substantial air space adjacent to the conductor, thereby reducing parasitic capacitance between conductors 47 and 48. Any reduced parasitic capacitance results from the substantial contribution of the low dielectric constant of air entrained in sleeves 51 and 45. Alternatively, the loose weave design for sleeves 51 and 45 may serve to mechanically damp small mechanical vibrations of conductors 47 and 48 that cause the parasitic capacitance between conductors 47 and 48 to vary. In certain circumstances, enclosing each individual strand 48*a*-48*c* seems to further enhance sound quality.

A third feature of cable 10 particularly compatible with fabric sleeves 51 and 45 and that provides improved sound quality, is the physical arrangement of the wires 44 and 25 in a ribbon format. Ribbon 10 includes a thin web or elongate sheet 28 that supports and maintains a nearly constant spacing between wires 44 and 25. The spacing between wires 44 and 25 that is currently preferred is approximately 0.75 in. (1.9 cm.), but the spacing can range from approximately 0.375 in. (0.9 cm.) to 1 in. (2.5 cm.). Variations in spacing along the length of ribbon 10 should be relatively small, perhaps no more than 20%.

Forming web 28 from paper or other ribbon having a low dielectric constant seems to provide better sound quality than most other materials. Forming web 28 from paper is a fourth design feature that seemingly improves overall sound quality. Experimental cables with ribbon 10 having a web 28 comprising various types of plastic for example, produce poorer sound quality than those with paper webs 28.

One theory that accounts for the improved performance when using paper is that paper has a low dielectric constant relative to most plastics, including the plastics used to form 75 Ω leader. The low dielectric constant in combination with the thinness of paper web 28 relative to 75 Ω leader, minimizes parasitic capacitance between conductors 47 and 48.

The several structural differences between 75 Ω leader and ribbon 10 result in a cable 1 that when used in audio systems to conduct audio signals, seems to provide superior sound quality relative to conventional audio cable designs, and also relative to 75 Ω leader with audio plug terminations. Experimentation may show that some improvement results in performance over conventional cables when using audio cables having 75 Ω leader as the cabling of an audio cable because 75 ohm leader at least has the ribbon format for the cable.

To fabricate a cable 1, one may use 2 in. wide paper-based masking tape or other tape having a low dielectric constant to form web 28. The two wires 44 and 25 are laid in parallel spacing on the tape. The tape is then folded over to bond the adhesive surface to itself between wires 44 and 25 and to overlap as at 50 around a portion of the periphery of ribbon 10. The tape thus provides both mechanical protection for wires 44 and 25 and forms the web 28 that maintains the desired spacing between wires 44 and 25.

Cutouts or voids 41 at intervals along web 28 may improve sound quality. However, since conductors 47 and 48 comprise relatively fragile strands, best practice is to keep the size of cutouts 41 relatively small.

Plugs 11 and 12 include bodies 18 and 32 supporting on one end of each, pins 15 and 38, and pins 35 and 53. Heavy conductive leads 21*a* and 55*a*, and 36*a* and 57*a* are firmly embedded at the ends of bodies 18 and 32 respectively, opposite pins 15, 35, 38, and 53. Conductor 48 is electrically connected to leads 21*a* and 36*a*. Conductor 47 is electrically connected to leads 55*a* and 57*a*. In plug 11, an internal conductor 21 connects lead 21*a* to pin 15 and an internal conductor 55 connects lead 55*a* to pin 35. Conductor 48 is electrically connected to leads 21*a* and 36*a*. Conductor 47 is electrically connected to leads 55*a* and 57*a*. In plug 12, conductor 35 connects lead 35*a* to pin 38 and conductor 57 connects lead 57*a* to pin 53.

Tape such as masking tape (not shown) is preferably wrapped around bodies 18 and 32 to overlap onto ribbon 10. This tape wrap protects the electrical connections and improves the mechanical strength of the connection between ribbon 10 and plugs 11 and 12.

The same general structure may be useful for speaker cables as well. Of course, speaker cables carry much higher currents, and therefore must be made from correspondingly larger strands. The width of the ribbon supporting the conductors should be greater as well.

FIG. 3 shows the cross section of a variation of the FIG. 2 conductor ribbon 10 that is suitable for an XLR cable. XLR cables have three conductors and three-pin plugs. The improved conductor cabling of FIG. 3 has three wires 25*a*, 25*b*, and 44 equally spaced around a central rope or heavy cord 71. Wires 25*a* and 25*b* have construction very similar to that of wire 25, and wire 44 is identical to wire 44 of FIG. 2. Each of the wires 25*a*, 25*b*, and 44 are equally spaced around rope 71.

Rope 71 has a substantially circular cross section with a loose weave, and may comprise heavy piping used in upholstery and formed from a natural fiber such as cotton or linen. The diameter of rope 71 may be in the range of approximately 0.375 in. (0.9 cm.) to 1 in. (2.5 cm.). Preferably the wires 25*a*, 25*b*, and 44 are spaced approximately equally from each other. An exterior cover 68 can comprise tape of sufficient width to enclose and securely position all three wires 25*a*, 25*b*, and 44 at approximate apices of an equilateral triangle.

Cabling having the structure shown in FIG. 3 is quite stiff, but a 1.5 m. length can be bent back on itself, which is usually sufficient to connect two audio component units. One can also use right angle plugs at the ends of if necessary to allow connections between audio system components that have sockets mounted on coplanar or parallel panels.

FIG. 4 shows a neutral wire 44 comprising two strands 47*a* and 47*b* of cross sections, and is otherwise similar to FIG. 2.

Figure 5:
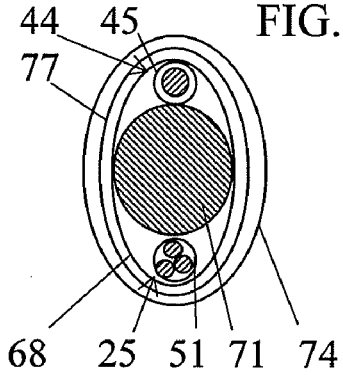
FIG. 5 is a longitudinal cross section of a variant of an audio cable showing two conductors and a rope-type spacer for a two-conductor audio cable.

FIG. 5 shows another variation for a two-conductor cable, and one that is currently preferred for commercial use. A loosely woven, natural fiber rope spacer 71 holds two wires 25 and 44 of the type shown in connection with FIGS. 1 and 2 in a spaced configuration. The rope spacer 71 may have a slightly tighter weave than sleeves 45 and 51 to provide substantially constant spacing between wires 25 and 44. Such a rope 71 with a slightly tighter weave may be compressible to 70% of its uncompressed volume under the conditions stated previously.

Wires 25 and 44 have loose weave natural fiber insulating sleeves 45 and 51 as in FIG. 2. Natural fiber thread 68 wraps loosely around wires 25 and 44 in a spiral manner to attach the wires to rope spacer 71.

A loose weave natural fiber sleeve 77 fits around wires 25 and 44, spacer 71, and thread 68. A carbon fiber sleeve 74 extends along the length of the cable and encloses spacer 71, wires 25 and 44, and thread 68. A preferred sleeve 74 comprising a carbon fiber mat or cloth provides mechanical protection and seems to shield wires 25 and 44 against EM interference as well.

For ease of understanding, FIG. 5 shows substantial spaces between sleeves 77 and 74. In a commercial embodiment, sleeves 77 and 74 fit much more snugly on the interior components than FIG. 5 shows. The entire cable structure is easy to assemble by sequentially pulling sleeve 77 and then sleeve 74 over the interior components.

The invention claimed is:

1. A high accuracy signal transmission cable to connect to first and second plugs each having at least positive and neutral terminals and compatible with sockets on entertainment equipment, comprising:

a) at least positive and neutral individual elongate conductors for connection between corresponding positive terminals and corresponding neutral terminals respectively, on the first and second plugs;

b) a tube of natural fiber material surrounding each conductor; and c) a spacer formed from a natural fiber interposed between and attached to the conductors to maintain a predetermined range of spacing between the conductors.

2. The cable of claim 1, wherein the spacer comprises one of a loosely woven rope and a paper ribbon.

3. The cable of claim 2, wherein the natural fiber forming the tubes surrounding the conductors comprises loosely woven cotton.

4. The cable of claim 3, wherein the conductors comprise strands formed of precious metal.

5. The cable of claim 4, wherein the positive conductor comprises at least two strands each comprising high purity precious metal.

6. The cable of claim 5, wherein the positive conductor wherein the spacer comprises silver with a gold coating.

7. The cable of claim 6, wherein the spacer has voids along the length of the conductors.

8. The cable of claim 5, wherein the neutral conductor comprises at least one strand of high purity precious metal.

9. The cable of claim 8, wherein the spacing between the conductors along the lengths thereof varies by less than approximately 20%.

10. The cable of claim 2, wherein the positive conductor comprises at least two strands each comprising high purity precious metal.

11. The cable of claim 10, wherein the neutral conductor comprises a single 26 ga. strand of 99.99% pure 24K gold with its own loose weave sleeve, two 28 ga. gold-plated silver strands with their own loose weave sleeves, and one 24 ga. and one 26 ga. gold-plated silver sharing a common loose weave sleeve.

12. The cable of claim 10, cable of claim 10, wherein the positive conductor comprises three conductive strands selected from the group of substantially pure gold, substantially pure silver, and substantially pure silver with a coating of substantially pure silver thereon.

13. The cable of claim 12, wherein the spacer comprises a rope formed of loosely woven cotton, and including two positive conductors and a neutral conductor, spaced approximately equally around the periphery of the rope.

14. The cable of claim 12, wherein the neutral conductor comprises at least one strand of high purity precious metal.

15. The cable of claim 14 wherein the neutral conductor comprises two strands of unequal diameter.

16. The cable of claim 15, wherein the spacer comprises a rope formed of loosely woven cotton.

17. The cable of claim 16, including a carbon fiber sleeve extending along the length of and enclosing the conductors and the spacer.

* * * * *